US008381840B2

(12) United States Patent
Nielsen et al.

(10) Patent No.: US 8,381,840 B2
(45) Date of Patent: Feb. 26, 2013

(54) METHOD OF PROTECTING A TOP DRIVE DRILLING ASSEMBLY AND A TOP DRIVE DRILLING ASSEMBLY MODIFIED IN ACCORDANCE WITH THIS METHOD

(76) Inventors: Shawn James Nielsen, Spruce Grove (CA); Sinisa Dobrijevic, Edmonton (CA)

( * ) Notice: Subject to any disclaimer, the term of this patent is extended or adjusted under 35 U.S.C. 154(b) by 274 days.

(21) Appl. No.: 12/625,920

(22) Filed: Nov. 25, 2009

(65) Prior Publication Data

US 2010/0263934 A1 Oct. 21, 2010

(51) Int. Cl.
*E21B 3/02* (2006.01)
*E21B 19/18* (2006.01)

(52) U.S. Cl. ..... 175/113; 166/77.51

(58) Field of Classification Search ..... 166/242.1, 166/77.1, 77.51; 175/57, 113, 162, 170, 175/203, 321; 267/188, 288, 289, 316, 317, 267/322.15, 322.18, 322.21, 322.22; 476/26, 476/27, 163

See application file for complete search history.

(56) References Cited

U.S. PATENT DOCUMENTS

| | | | | |
|---|---|---|---|---|
| 3,382,936 | A * | 5/1968 | Galle | 175/321 |
| 4,055,338 | A * | 10/1977 | Dyer | 267/125 |
| 4,325,691 | A | 4/1982 | Evans et al. | |
| 4,402,495 | A * | 9/1983 | Dyer | 267/125 |
| 4,421,179 | A | 12/1983 | Boyadjieff | |
| 4,458,768 | A | 7/1984 | Boyadjieff | |
| 4,593,773 | A * | 6/1986 | Skeie | 175/85 |
| 4,605,077 | A | 8/1986 | Boyadjieff | |
| 4,813,493 | A * | 3/1989 | Shaw et al. | 173/164 |
| 4,813,498 | A | 3/1989 | Lynch et al. | |
| 4,844,181 | A * | 7/1989 | Bassinger | 175/195 |
| 5,107,940 | A | 4/1992 | Berry | |
| 5,133,419 | A * | 7/1992 | Barrington | 175/321 |
| 5,371,841 | A * | 12/1994 | Jones | 345/619 |
| 5,433,279 | A | 7/1995 | Tessari et al. | |
| 5,476,421 | A * | 12/1995 | Moore et al. | 464/20 |
| 5,755,289 | A | 5/1998 | Angman et al. | |
| 6,199,641 | B1 | 3/2001 | Downie et al. | |
| 6,679,333 | B2 | 1/2004 | York et al. | |
| 6,688,398 | B2 | 2/2004 | Pietras | |
| 6,725,949 | B2 | 4/2004 | Seneviratne | |
| 6,913,096 | B1 | 7/2005 | Nielsen et al. | |
| 6,938,697 | B2 * | 9/2005 | Haugen | 166/380 |
| 7,004,259 | B2 | 2/2006 | Pietras | |
| 7,137,454 | B2 * | 11/2006 | Pietras | 166/380 |
| 7,140,443 | B2 | 11/2006 | Beierbach et al. | |
| 7,231,969 | B2 * | 6/2007 | Folk et al. | 166/77.51 |
| 2003/0173073 | A1 * | 9/2003 | Snider et al. | 166/78.1 |
| 2005/0000684 | A1 * | 1/2005 | Slack et al. | 166/77.1 |
| 2006/0032638 | A1 * | 2/2006 | Giroux et al. | 166/377 |
| 2006/0124353 | A1 * | 6/2006 | Juhasz et al. | 175/40 |
| 2007/0074876 | A1 * | 4/2007 | Pietras | 166/379 |
| 2009/0044982 | A1 * | 2/2009 | Wells et al. | 175/52 |
| 2010/0218935 | A1 * | 9/2010 | Matherne et al. | 166/77.51 |

FOREIGN PATENT DOCUMENTS

| | | |
|---|---|---|
| CA | 2382668 | 10/2003 |

* cited by examiner

*Primary Examiner* — Brad Harcourt
*Assistant Examiner* — Michael Wills, III
(74) *Attorney, Agent, or Firm* — Davis & Bujold, PLLC

(57) ABSTRACT

A method of protecting a top drive drilling assembly includes incorporating a shock absorbing sub incorporated in the top drive drilling assembly. The shock absorbing sub comprises a first body and a second body capable of relative axial movement, with a shock absorbing medium disposed between the first body and the second body to absorb any reactive axial force exerted upon the top drive drilling assembly.

4 Claims, 2 Drawing Sheets

METHOD OF PROTECTING A TOP DRIVE DRILLING ASSEMBLY AND A TOP DRIVE DRILLING ASSEMBLY MODIFIED IN ACCORDANCE WITH THIS METHOD

FIELD

A method of protecting a top drive drilling assembly and a top drive drilling assembly modified in accordance with this method.

BACKGROUND

The drilling of hydrocarbon producing wells is being performed with increasing frequency using drilling rigs equipped with top drive drilling assemblies. Top drive drilling assemblies are not as robust as rotary tables and presently require frequent maintenance with potential areas of failure being bearings that rotatably support the quill, gears that rotatably drive the quill and thread forms that enable the quill to be coupled to a drill string.

SUMMARY

According to one aspect there is provided a method of protecting a top drive drilling assembly. A shock absorbing sub is incorporated in the top drive drilling assembly. The shock absorbing sub comprises a first body and a second body capable of relative axial movement, with a shock absorbing medium disposed between the first body and the second body to absorb any reactive axial force exerted upon the top drive drilling assembly.

According to an aspect there is provided a top drive drilling assembly, comprising, in combination, a top drive unit, and a shock absorbing sub. The top drive unit comprise a main body and a quill mounted within the main body. The quill has a thread form to facilitate coupling of the quill to a drill string. The quill is supported by bearings which permit the quill to rotate within the body. There is a drive motor and a gear assembly to convert motive force provided by the drive motor into rotary motion of the quill. The shock absorbing sub comprises a first body having a first coupling adapted to couple the first body with the thread form of the quill, and a second body having a second coupling adapted to couple the second body with a drill string. The first body and the second body are capable of relative axial movement. A shock absorbing medium is disposed between the first body and the second body to absorb any reactive axial force exerted upon the top drive drilling assembly.

BRIEF DESCRIPTION OF THE DRAWINGS

These and other features will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION

Figure 2:
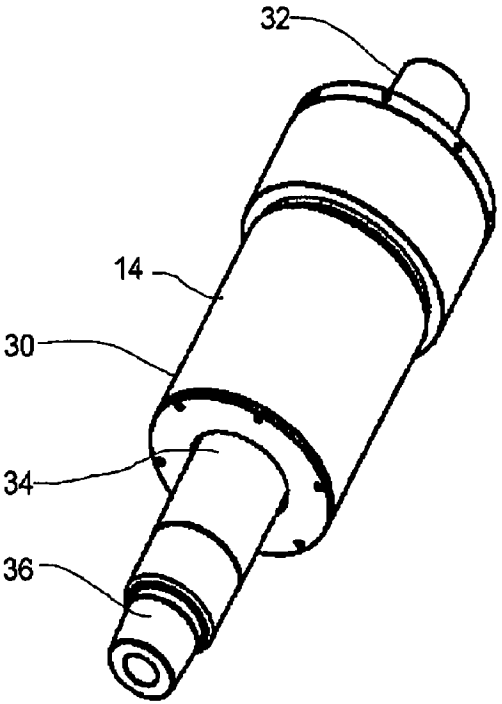
FIG. 2 is a perspective view of a shock absorbing sub.

A top drive drilling assembly generally identified by reference numeral 10, will now be described with reference to FIG. 1 through 4.

Figure 1:
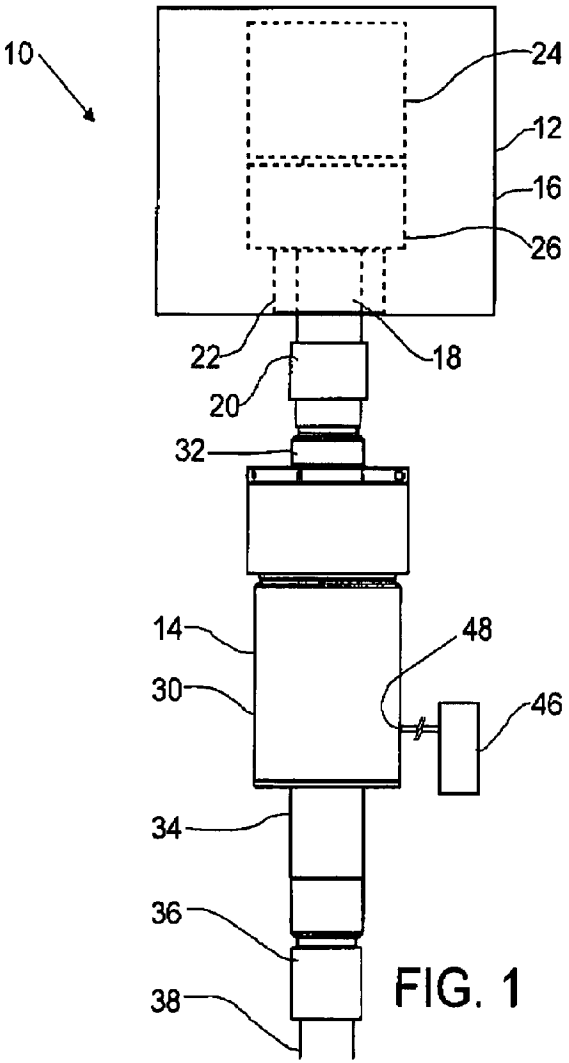
FIG. 1 is a schematic side elevation view of a top drive drilling assembly.

Structure and Relationship of Parts:

Referring to FIG. 1, top drive drilling assembly 10 includes, in combination, a top drive unit 12 and a shock absorbing sub 14. Shock absorbing sub 14 is intended to help protect the bearings, gears, and other components associated with a quill 18.

Referring to FIG. 1, top drive unit 12 includes a main body 16 and quill 18 mounted within main body 16. Quill 18 has a thread form 20 to facilitate coupling of quill 18 to a drill string. Quill 18 is supported by bearings 22 which permit quill 18 to rotate within body 16. Top drive unit 12 also has a drive motor 24 and a gear assembly 26 to convert motive force provided by drive motor 24 into rotary motion of quill 18. The top drive unit 12 shown in FIG. 1 is a generic schematic showing the necessary components. It will be understood that different designs of top drive units 12 may be used.

Figure 3:
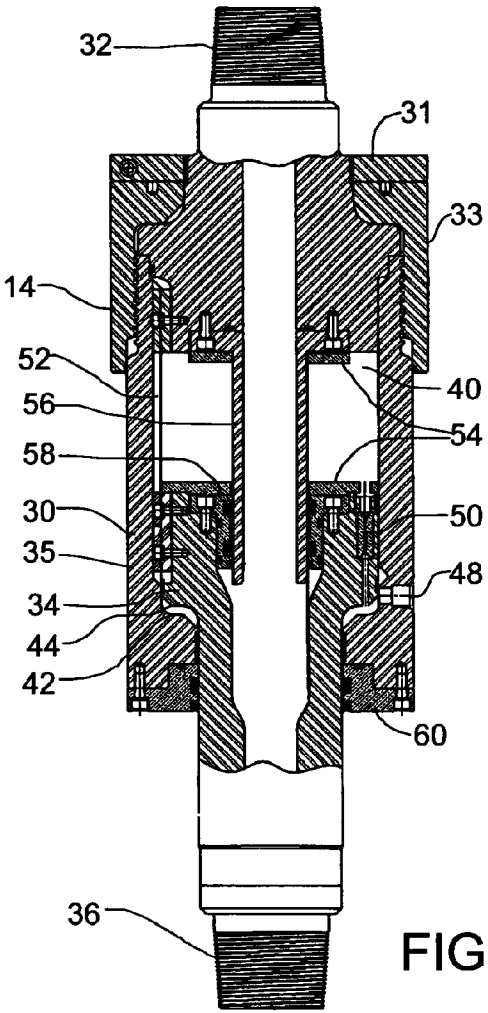
FIG. 3 is a side elevation view in section of the shock absorbing sub in an extended position.

Referring to FIG. 2, shock absorbing sub 14 includes a first body, such as an outer housing 30 that has a first coupling 32 adapted to couple first body 30 with thread form 20 of quill 18. As depicted in FIG. 3, outer housing 30 may be made up of various components, such as a lock nut 31, a load nut 33, and a main barrel 35. Referring to FIG. 3, a second body, such as an inner mandrel 34 has a second coupling 36 adapted to couple second body 34 with a drill string 38. Inner mandrel 34 is received within outer housing 30. Housing 30 and inner mandrel 34 are capable of relative axial movement between an extended position as shown in FIG. 3 and a retracted position shown in FIG. 4. In the extended position, more of inner mandrel 34 protrudes from outer housing 30 than in the retracted position. A shock absorbing medium 40 is disposed between first body, or outer housing 30 and second body, or inner mandrel 34, to absorb any reactive axial force exerted upon top drive drilling assembly 10. Medium 40 is preferably a fluid that is inert and has an appropriate phase change temperature. For example, water is not ideal as it may freeze, and air, which contains oxygen, is not ideal as it is not inert. Suitable fluids include substances such as oil, lubricants, or nitrogen. Referring to FIG. 3, fluid is supplied through outer housing 30 via a fluid fill port 48. As inner mandrel 34 moves relative to outer housing 30, fluid passes through an orifice 50 from one side of inner mandrel 34 to the other. To prevent relative rotation of outer housing 30 and inner mandrel 34, a keyway 52 is provided that locks the two bodies together rotationally, but still allows movement along the axis. While keyway 52 is shown, it will be understood that splines or other strategies for preventing rotation could also be used, as will be recognized by those skilled in the art. Replaceable wear plates 54 may also be provided to prevent unnecessary damage to inner components and to facilitate maintenance and repair. A seal sleeve 56 extends downward from the outer housing 30 into inner mandrel 34. Seal sleeve 56 maintains the relative radial positions during axial movement, and also engages a seal cartridge 58 carried by inner mandrel 34. Outer housing also carries a seal cartridge 60. Seal cartridges 58 and 60 seal against the unwanted escape of fluid.

As depicted, outer housing 30 has an inner stop 42 and inner mandrel 34 has an outer stop 44. In the extended position, inner stop 42 of outer housing 30 engages outer stop 44 of inner mandrel 34 to prevent separation of outer housing 30 and inner mandrel 34.

Referring to FIG. 1, a fluid supply unit 46 supplies fluid 40. Fluid supply unit 46 is capable of altering the pressure at which the fluid is supplied in order to selectively increase or or decrease dampening characteristics of fluid 40 to suit changing drilling conditions.

Operation:

Referring to FIG. 1, quill 18 of top drive drilling assembly 10 may be protected by incorporating a shock absorbing sub 14 as described above into top drive drilling assembly Shock absorbing sub 14 is inserted between quill 18 and drill string 38 by attaching thread form 20 of quill 18 to a first coupling 32 of shock absorbing sub 14 and by attaching second coupling 36 of inner mandrel 34 to drill string 38.

Figure 4:
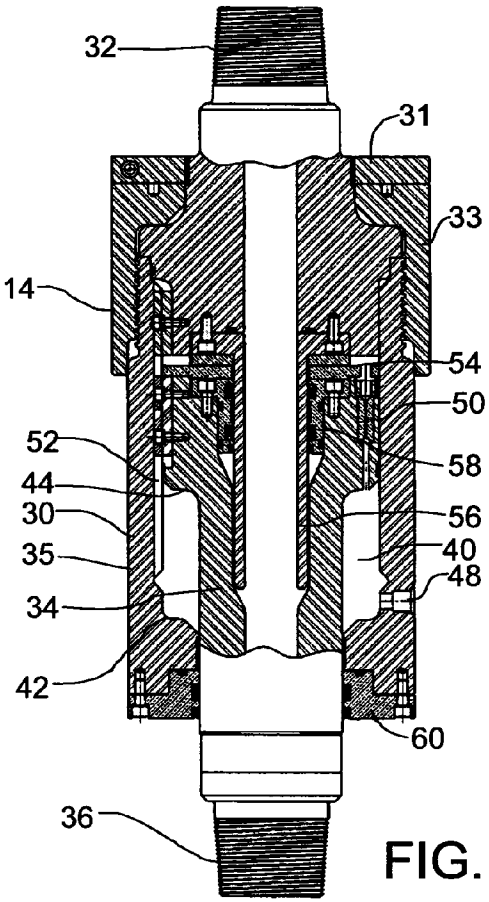
FIG. 4 is a side elevation view in section of the shock absorbing sub in a retracted position

Drive motor 24 of top drive unit 12 may then be activated to rotate quill 18, shock absorbing sub 14 and drill string 38. Referring to FIGS. 3 and 4, when drill string 38 transmits a force along its length, such as when an obstacle is encountered downhole, inner mandrel 34 moves axially relative to outer housing 30 to help absorb the force and reduce the impact on quill 18 and top drive unit 12. As the force is received by inner mandrel 34, fluid passes through orifice 50 from one side of inner mandrel 34 to another. The force absorbing characteristics may be modified by changing the size of orifice 50, increasing the number of orifices 50, or adjusting the pressure of fluid in shock absorbing sub 14 by modifying fluid supply unit 46 shown in FIG. 1.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiments without departing from scope of the Claims.

What is claimed is:

1. A method of protecting a top drive drilling assembly, the method comprising the steps of:

incorporating, in the top drive drilling assembly, a shock absorbing sub comprising a first body and a second body coupled to provide continual relative axial movement between an extended position and a retracted position during an earth drilling operation, with a shock absorbing fluid medium disposed between the first body and the second body to absorb any reactive axial force exerted upon the top drive drilling assembly, adapting the first body of the shock absorbing sub having a first coupling for coupling the shock absorbing sub with a thread form of a quill and the second body of the shock absorbing sub having a second coupling adapted to couple the shock absorbing sub with a drill string, and supplying the shock absorbing fluid medium through a fluid fill port on the first body connected to a supply unit capable of selectively increasing or decreasing the pressure of the shock absorbing fluid medium, located between the first body and the second body, to selectively increase or decrease dampening characteristics of the shock absorbing fluid medium to suit changing drilling conditions.

2. A top drive drilling assembly, comprising in combination:

a top drive unit, comprising:

a main body;

a quill mounted within the main body, the quill having a thread form to facilitate coupling of the quill to a drill string, the quill being supported by bearings which permit the quill to rotate within the body;

a drive motor; and a gear assembly to convert motive force provided by the drive motor into rotary motion of the quill; and a shock absorbing sub, comprising:

a first body having a first coupling adapted to couple the first body with the thread form of the quill;

a second body having a second coupling adapted to couple the second body with a drill string, the first body and the second body being coupled to provide continual relative axial movement during an earth drilling operation between an extended position and a retracted position;

a shock absorbing fluid medium disposed between the first body and the second body to absorb any reactive axial force exerted upon the top drive drilling assembly; and a supply unit connected to supply fluid to a fluid fill port on the first body and capable of selectively increasing or decreasing the pressure of the shock absorbing fluid medium, located between the first body and the second body, to selectively increase or decrease dampening characteristics of the shock absorbing fluid medium to suit changing drilling conditions.

3. The top drive assembly of claim 2, wherein the first body is a tubular outer housing and the second body is an inner mandrel that is received within the outer housing, the inner mandrel being capable of axial movement between the extended position and the retracted position, in the extended position more of the inner mandrel protrudes from the outer housing than in the retracted position.

4. The top drive assembly of claim 3, wherein the outer housing has an inner stop and the inner mandrel has an outer stop, the inner stop of the outer housing engaging the outer stop of the inner mandrel to prevent separation of the outer housing and the inner mandrel in the extended position.

* * * * *